United States Patent [19]

Zopf

[11] 4,130,153

[45] Dec. 19, 1978

[54] GOLF BAG CLUB SEPARATOR

[76] Inventor: David E. Zopf, 2216 Marilyn Plaza, Lansing, Mich. 48910

[21] Appl. No.: 882,577

[22] Filed: Mar. 2, 1978

[51] Int. Cl.[2] ..... A63B 55/00

[52] U.S. Cl. ..... 150/1.5 R; 220/22

[58] Field of Search ..... 150/1.5 R, 1.5 B, 1.5 C; 220/22, 22.3

[56] References Cited

U.S. PATENT DOCUMENTS

| | | | |
|---|---|---|---|
| 2,105,853 | 1/1938 | Brodie | 150/1.5 R |
| 2,478,621 | 8/1949 | Attula | 220/22 X |
| 3,331,419 | 7/1967 | Bencriscutto | 150/1.5 R |
| 3,656,651 | 4/1972 | Hage | 220/22.3 |
| 3,656,786 | 4/1972 | Larson | 220/22 X |
| 3,674,072 | 7/1972 | Shuto | 150/1.5 R |
| 3,842,876 | 10/1974 | Cristelli | 150/1.5 R |

*Primary Examiner*—Donald F. Norton

[57] ABSTRACT

A golf bag club separator which consists of an insert adapted for selective positioning within the bottom portion of a golf bag so as to selectively divide the lower portion of the golf bag into a plurality of compartments. The insert consists of a vertical divider panel having vertically oriented arcuately curved opposed end panel portions which are adapted to matingly abut against the inside wall surface of the golf bag. The vertical edges of each curved end panel are provided with wall engaging flanges therealong. In one embodiment of the invention, the arcuately curved opposed end panel portions are each provided with vertically oriented spaced-apart flanges which define a channel therebetween which is adapted to retentively engage the vertical edges of the divider panel so as to retain the divider panel in its vertical operative use position. Various other embodiments of the insert utilize multiple variably configured divider panels integral with the curved end panel portions so as to selectively divide the lower portion of the golf bag into a corresponding number of compartments.

3 Claims, 19 Drawing Figures

GOLF BAG CLUB SEPARATOR

SUMMARY OF THE INVENTION

This invention relates to a golf bag club separator and more specifically to an insert adapted for selective positioning within the bottom portion of a golf bag so as to selectively divide the lower portion of the golf bag into a plurality of compartments. The insert consists of a vertical divider panel integrally provided with arcuately curved vertically oriented opposed end panel portions which are adapted to matingly abut against the inside wall surface of the golf bag. The vertical edges of each curved end panel are provided with wall engaging flanges therealong. In one embodiment of the invention, a knock-down version of the insert is provided wherein each of the arcuately curved end panel members are provided with a pair of spaced-apart flanges which extend radially inwardly from the concave surface thereof so as to define a channel therebetween which is adapted to retentatively engage the vertical edges of the divider panel so as to retain the divider panel in its vertical operative use position therebetween within the golf bag. The knock-down version of the invention adds great versatility to the invention in that the curved end panels can be mass produced in quantity while divider panels of different widths can be produced so as to selectively adapt the insert for use in golf bags having different diameters. Other embodiments of the insert utilize multiple variably configured divider panels integral with the curved end panels so as to selectively divide the lower portion of a golf bag into a corresponding number of compartments.

Another embodiment of the invention consists of a vertically oriented divider panel which is co-extensive with and extends upwardly from a circular horizontal base panel which is adapted to rest against the bottom of the golf bag. A plurality of upwardly extending variably configured divider panels can be provided on the circular base panel so as to provide any desired number of corresponding compartments.

Yet another embodiment of the invention consists of a cylindrical container base having one or more vertical divider panels provided therein so as to provide compartments in the lower portion of the golf bag. This container base is adapted to form the base of the golf bag with the flexible wall of the golf bag attached thereto.

None of the devices of the known prior art teach the use of an insert such as that of the present invention whereby one or more vertical divider panels are selectively positioned in the bottom portion of a golf bag so as to form a plurality of golf club separator compartments therein. Further, none of the devices of the prior art teach the use of a golf bag club separator insert having a "knock-down" capability which makes it selectively adaptable for use in golf bags of different size diameters by merely varying the width of the divider panels. Representative of the prior art patents are U.S. Pat. Nos. Brodie 2,105,853, Bencriscutto 3,331,419, McFadden 3,729,036 and Cristelli 3,842,876.

It is thus seen that a highly utilitarian golf bag club separator insert is provided which can be easily and inexpensively fabricated because of its simplified configuration.

It is therefore an object of this invention to provide a simple golf bag club separator insert for selective insertion into a golf club bag so as to provide multiple compartments in the lower portion of the golf bag.

Another embodiment of this invention is to provide a "knock-down" embodiment of the invention so that the insert can be easily adapted to fit golf bags having different inside diameters.

Other objects will be apparent to those skilled in the art upon reading the present description, drawings and claims.

IN THE DRAWINGS

FIGS. *9a, 9b* and *9c* are top views of modified forms of the insert showing various representative configurations of the divider walls.

Figure 10:
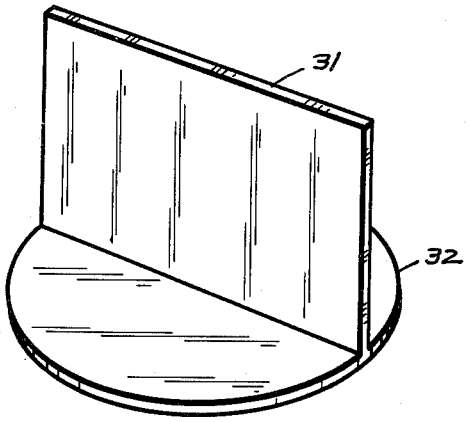

FIG. 10 is a perspective view of a modified form of the insert showing the vertical divider wall extending upwardly from a circular base panel.

Figure 11:
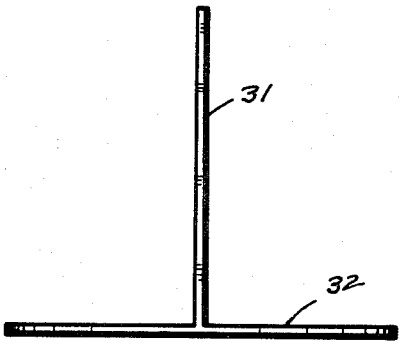

FIG. 11 is a side elevational view of the modified form of the insert shown in FIG. 10.

Figure 12:
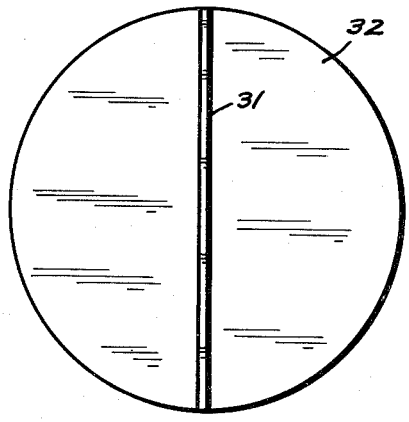

FIG. 12 is a top view of the modified form of the insert shown in FIG. 10.

Figure 13:
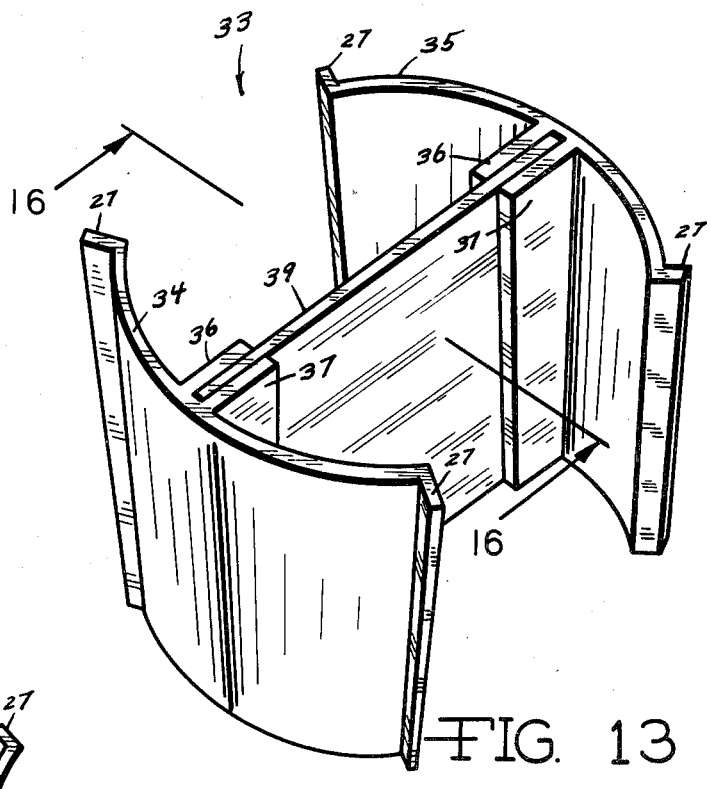

FIG. 13 is a modified form of the insert showing the divider detachably mounted between the two opposed curved end panels.

Figure 14:
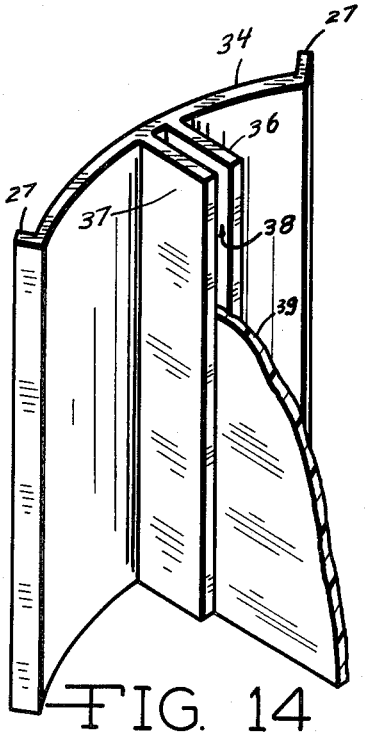

FIG. 14 is a partial perspective view of the modified form of the insert shown in FIG. 13 showing the divider panel in engagement with the channel provided on the curved end panel.

Figure 15:
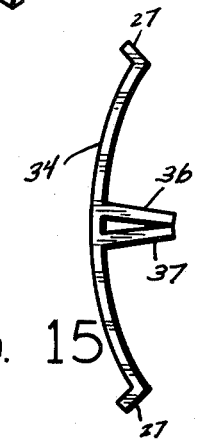

FIG. 15 is a top view of one of the curved end panels of the modified form of the insert shown in FIG. 13.

Figure 16:
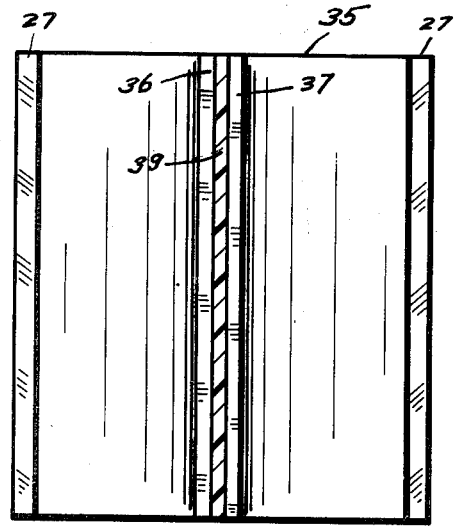

FIG. 16 is a cross-sectional view of the insert taken on line 16—16 of FIG. 13.

Figure 17:
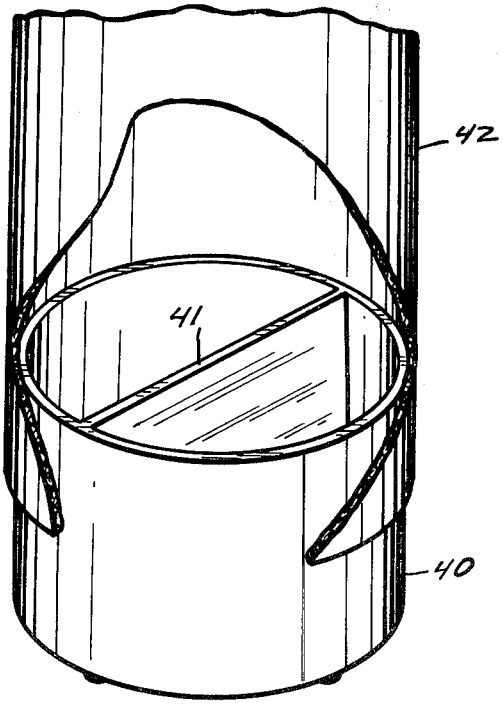

FIG. 17 is a modified form of the golf bag club separator unit showing a vertical divider wall positioned within a cylindrical base unit.

DESCRIPTION

Figure 1:
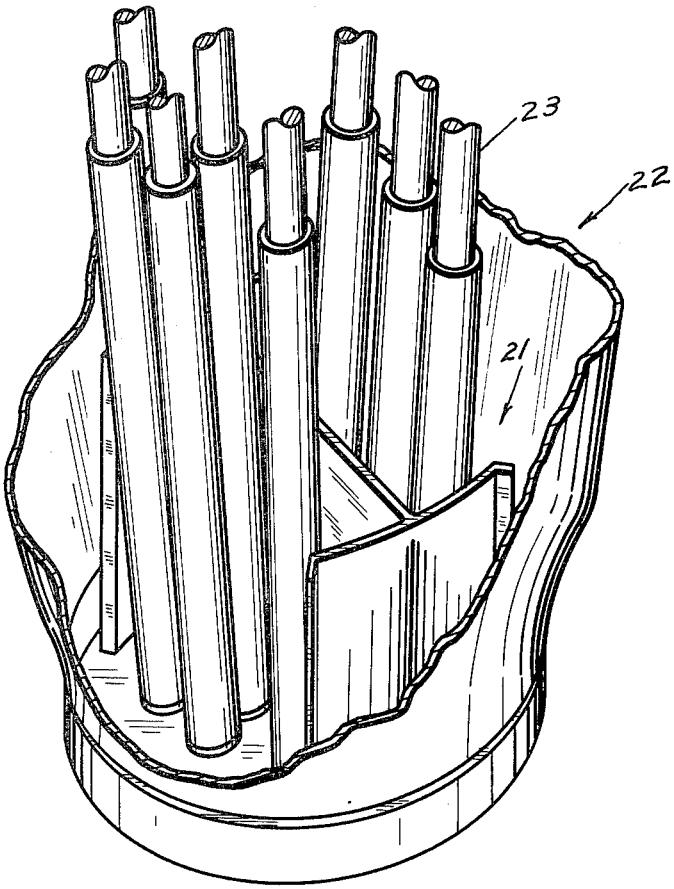
FIG. 1 is a perspective view of the golf bag club separator insert in its operative use position within the lower portion of a golf bag.
Figure 2:
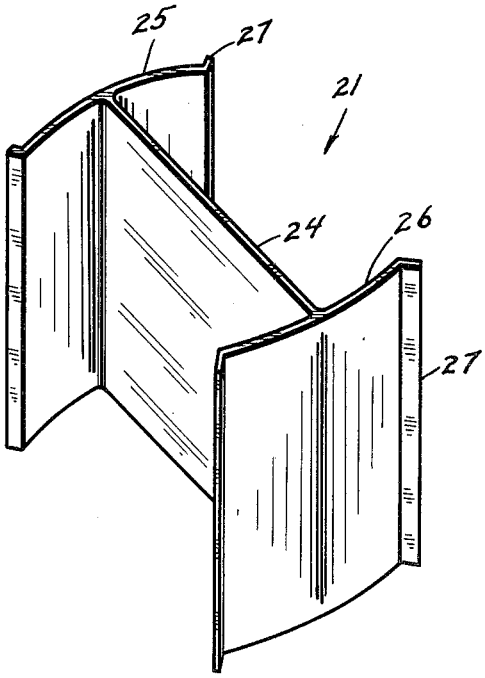
FIG. 2 is a perspective view of the golf bag club separator insert.
Figure 3:
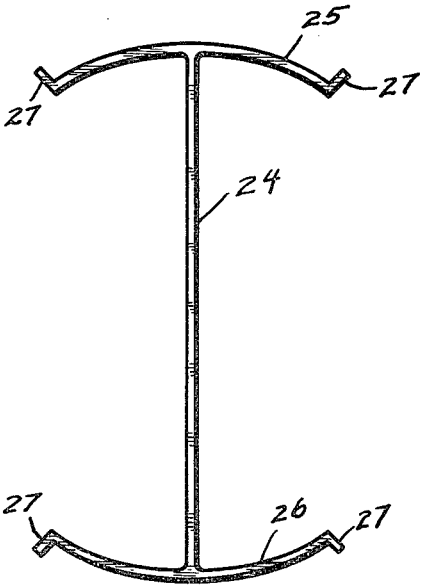
FIG. 3 is a top view thereof.
Figure 4:
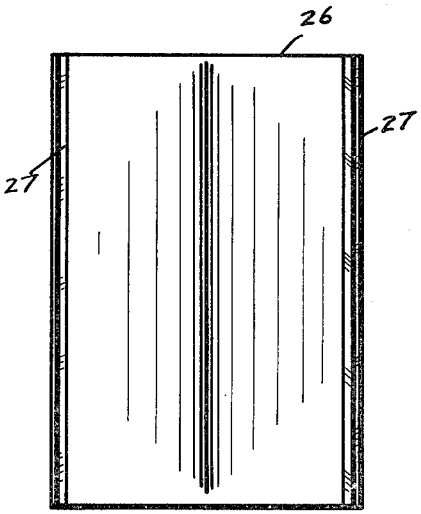
FIG. 4 is a side elevational view thereof.
Figure 5:
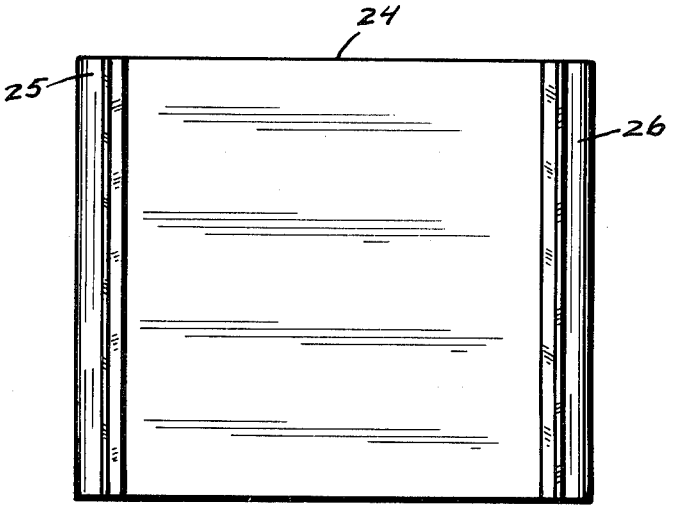
FIG. 5 is a front elevational view thereof.

As shown in FIG. 1, the golf bag club separator insert 21 is selectively positioned within the lower portion of a golf bag 22 so as to divide the lower portion thereof into compartments into which golf club handles 23 can be placed. As shown in FIGS. 2 through 5, the insert 21 consists of a vertical divider wall panel 24 which is provided with integral arcuately curved opposed end panels 25 and 26. The end panels 25 and 26 are provided with wall-engaging flange portions 27 along the vertical edges thereof. The insert 21 can be incorporated into the golf bag when the bag is manufactured or can be inserted into any existing golf bag. Due to the simple design of the insert, it can be easily extruded by use of any desired plastic material.

Figure 6:
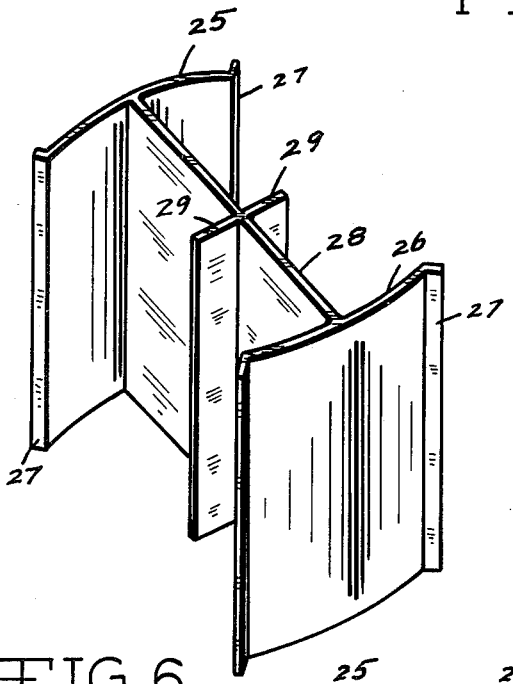
FIG. 6 is a perspective view of a modified form of the insert.
Figure 7:
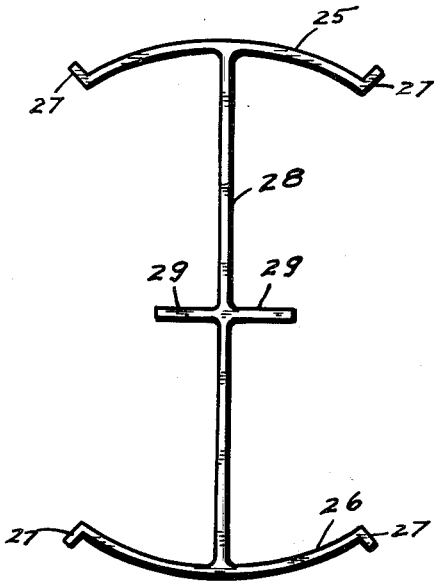
FIG. 7 is a top view of the modified form of the insert shown in FIG. 6.
Figure 8:
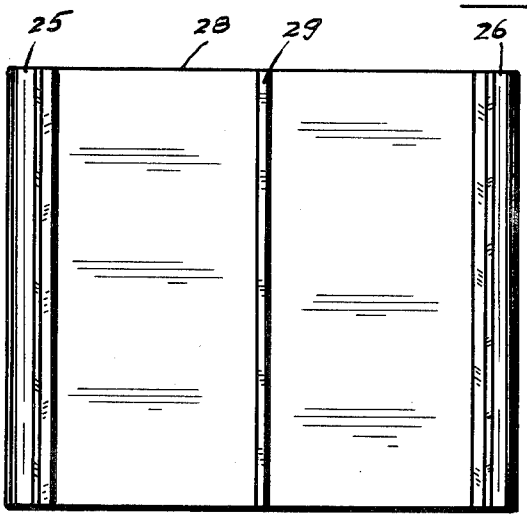
FIG. 8 is a front elevational view of the modified form of the insert shown in FIG. 6.
Figure 9A:
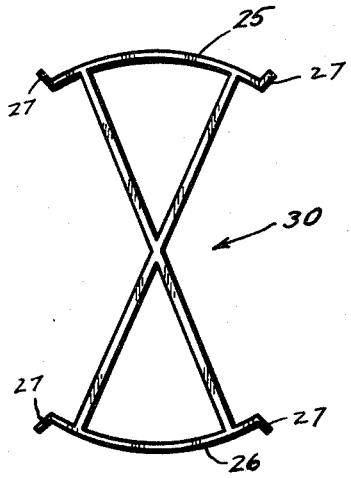
Figure 9B:
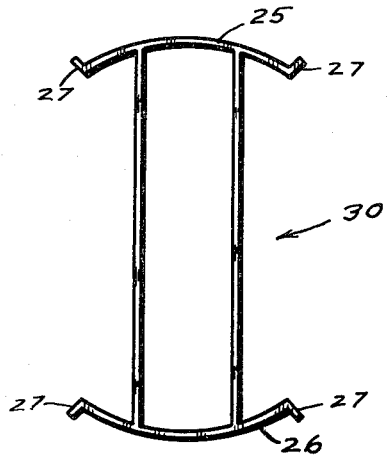
Figure 9C:
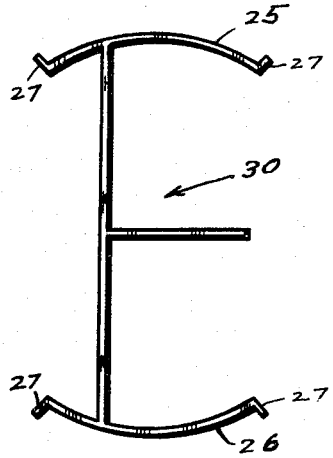

As shown in FIGS. 6 through 8, the insert 21 can be selectively modified to provide various configurations of the divider wall panel 24. A divider wall panel 28 is provided having divider wall panel flanges 29 extending perpendicularly therefrom. As shown in FIGS. 9a, 9b and 9c, multiple divider panels 30 of any desired configuration can be positioned between the opposed curved end panel portions 25 and 26.

Another modified form of the insert is shown in FIGS. 10, 11 and 12 wherein a vertically oriented divider panel 31 is provided on a circular base panel 32. In use, the base panel 32 rests on the bottom surface within the golf club bag and the divider panel 31 extends upwardly therefrom. A modified insert 33 is shown in FIGS. 13 through 16. Each of the opposed curved end panels 34 and 35 are provided with a pair of spaced-apart flanges 36 and 37 which extended radially inwardly from the concave surfaces thereof so as to define a channel 38 therebetween. The channels 38 are adapted to retainably engage the vertical edges of the divider panel 39. As shown in FIG. 15, the flanges 36 and 37 which form the channel 38 can be selectively biased against each other so as to exert a retentive pressure against a divider panel 39 inserted therebetween.

The "knock-down" or dismantleable capability of the insert 33 gives added versatility to this embodiment of the invention. The end wall panels 34 and 35 are configured so as to be useable in golf bags of various size diameters. By selectively providing divider panels 39 of selected lengths it is possible to easily adapt the insert 33 for use in golf bags of any size diameter. Thus, it is not necessary to produce and maintain inventories of various sizes of complete inserts to accommodate all sizes of golf bags.

Another embodiment of the invention is shown in FIG. 17 wherein a cylindrical container base 40 is provided with a divider panel 41 positioned therein. It is within the scope of the invention to vary the number and configuration of the divider panels positioned within the cylindrical container base 40 so as to provide a plurality of compartments as desired. As shown in FIG. 17, this modified embodiment of the invention acts as the base of the golf bag with the flexible side wall 42 affixed thereto.

It is thus seen that a highly utilitarian golf bag club separator insert is provided which consists of an insert which can be easily and economically produced due to its simplicity of design. Further, the insert can be modified so as to have a knock-down capability which imparts great versatility to the insert in that it can be easily adapted for use in golf bags of various sizes.

Various other modifications of the invention may be made without departing from the principle thereof. Each of the modifications is to be considered as included in the hereinafter appended claims, unless these claims by their language expressly provide otherwise.

I claim:

1. In a golf bag club separator, the combination comprising:

a pair of opposed spaced-apart arcuately curved vertically oriented end panels, each of said end panels having a pair of spaced-apart flanges extending radially inwardly from the concave surface thereof so as to define a divider panel engaging channel therebetween; and a divider wall panel in selective engagement with each of said channels provided on said end panels.

2. In an end panel member for use in a golf bag club separator, the combination comprising:

an end panel member having an arcuate cross-sectional configuration, said end panel member having a pair of spaced-apart flanges extending radially inwardly from the concave surface thereof so as to define a divider panel engaging channel therebetween.

3. In the end panel member of claim 2 wherein said flanges are biased toward each other so as to exert a retentive force against a divider panel edge inserted therebetween.

* * * * *